US008112868B2

(12) United States Patent
Miller

(10) Patent No.: US 8,112,868 B2
(45) Date of Patent: Feb. 14, 2012

(54) METHOD FOR MANUFACTURING CUSTOM CHAIRS

(75) Inventor: David H. Miller, Grand Rapids, MI (US)

(73) Assignee: Grand Rapids Chair Company, Grand Rapids, MI (US)

( * ) Notice: Subject to any disclaimer, the term of this patent is extended or adjusted under 35 U.S.C. 154(b) by 884 days.

(21) Appl. No.: 12/135,486

(22) Filed: Jun. 9, 2008

(65) Prior Publication Data

US 2008/0301927 A1 Dec. 11, 2008

Related U.S. Application Data

(60) Provisional application No. 60/933,809, filed on Jun. 8, 2007.

(51) Int. Cl.
*B23P 11/00* (2006.01)

(52) U.S. Cl. ..... 29/525.01; 29/557; 29/458; 29/428; 297/440.12; 297/440.13; 297/440.2; 297/440.21

(58) Field of Classification Search ..... 279/440.12, 279/440.13, 440.2; 29/525.01, 557, 428, 29/458

See application file for complete search history.

(56) References Cited

U.S. PATENT DOCUMENTS

| | | | | |
|---|---|---|---|---|
| 2,479,086 A | | 8/1949 | Silverman | |
| 2,656,550 A | * | 10/1953 | Loeb | 5/295 |
| 3,870,366 A | | 3/1975 | Rogers | |
| 4,140,065 A | | 2/1979 | Chacon | |
| 4,900,085 A | | 2/1990 | Tobler | |
| 4,919,485 A | * | 4/1990 | Guichon | 297/440.23 |
| 5,275,467 A | | 1/1994 | Kawecki | |
| 5,277,476 A | | 1/1994 | Caldwell | |
| 5,328,245 A | | 7/1994 | Marks et al. | |
| 5,407,250 A | * | 4/1995 | Prince et al. | 297/440.2 |
| 5,611,598 A | | 3/1997 | Knoblock | |
| 5,660,439 A | | 8/1997 | Unwalla | |
| 5,775,778 A | | 7/1998 | Riley et al. | |
| 5,795,028 A | | 8/1998 | Dussia, Jr. et al. | |
| 5,829,830 A | * | 11/1998 | Maloney | 297/230.13 |
| 5,878,470 A | * | 3/1999 | Blansett | 29/91.1 |
| 5,992,938 A | | 11/1999 | Jones | |
| 6,234,571 B1 | | 5/2001 | Atkins et al. | |

(Continued)

FOREIGN PATENT DOCUMENTS

WO WO 2007038879 A1 * 4/2007

OTHER PUBLICATIONS

MTS Seating; www.mtsseating.com; Catalog; Jun. 1, 2007.*

(Continued)

*Primary Examiner* — David Bryant
*Assistant Examiner* — Bayan Salone
(74) *Attorney, Agent, or Firm* — Dickinson Wright PLLC

(57) ABSTRACT

A method for manufacturing a chair assembly (20) with a customized backrest (46) includes fabricating a standardized frame (22), preparing a contoured plywood blank (48) for the backrest (46), selecting a customized design for the backrest (46) and then converting the design for the backrest (46) into a readable format, loading the readable format for the backrest (46) design into a customized cutting apparatus, loading the blank (48) into the cutting apparatus, cutting the blank (48) in conformity with the selected backrest (46) design, removing the completed blank (48) from the cutting apparatus, mounting the backrest (46) onto the frame (22), and lastly, mounting a seat (36) onto the frame (22).

18 Claims, 6 Drawing Sheets

U.S. PATENT DOCUMENTS

| | | | | |
|---|---|---|---|---|
| 6,422,654 | B1 * | 7/2002 | Grove | 297/440.16 |
| 6,568,058 | B1 | 5/2003 | Wieland et al. | |
| 6,843,529 | B2 * | 1/2005 | Ballendat | 297/239 |
| 6,931,708 | B1 * | 8/2005 | Elwell | 29/428 |
| 6,955,402 | B2 | 10/2005 | VanDeRiet et al. | |
| 7,604,298 | B2 * | 10/2009 | Peterson et al. | 297/440.2 |
| 2004/0026980 | A1 * | 2/2004 | Tseng | 297/440.16 |
| 2006/0117548 | A1 * | 6/2006 | Kozlowski | 29/557 |
| 2007/0222268 | A1 * | 9/2007 | Saez et al. | 297/354.11 |
| 2008/0218857 | A1 * | 9/2008 | Kozlowski | 359/478 |

OTHER PUBLICATIONS

MTS Seating, Termperance, Michigan, 2007 Workbook & Pricelist, Front Page and p. 96, "Custom Back Designs."

* cited by examiner

FIG - 8
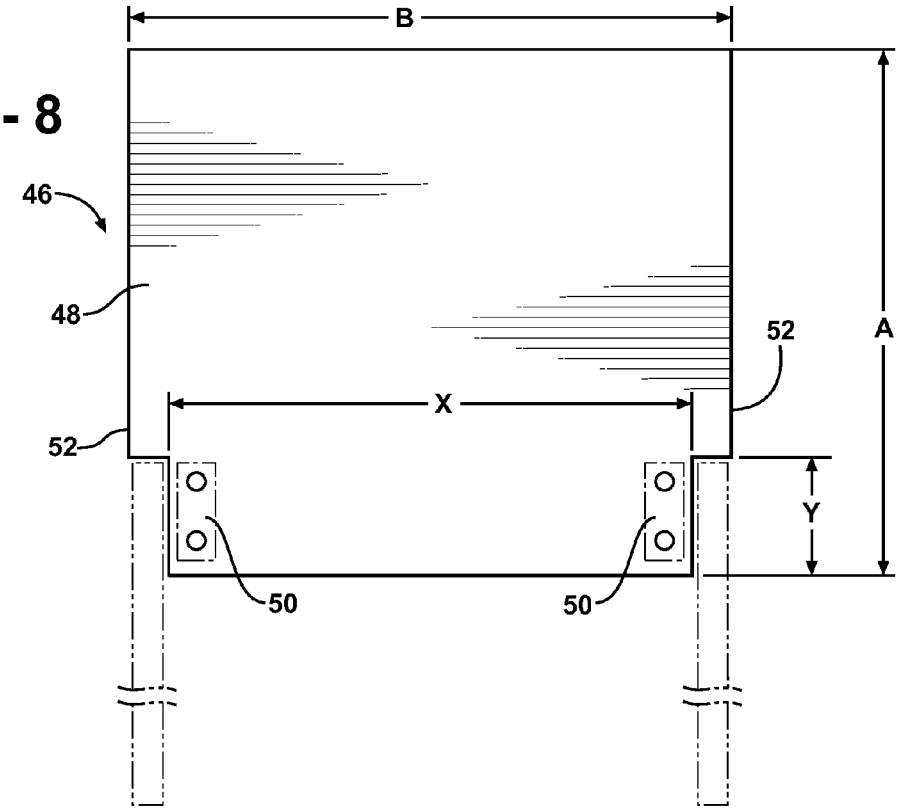
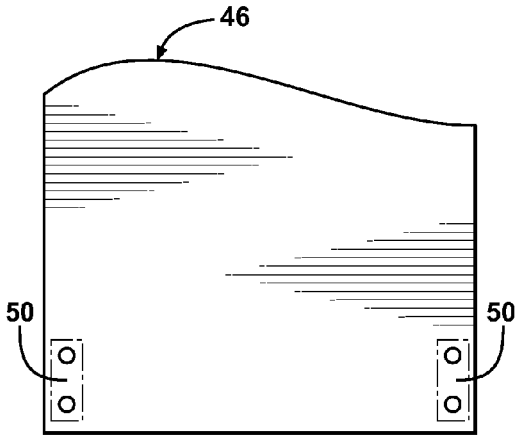
FIG - 9
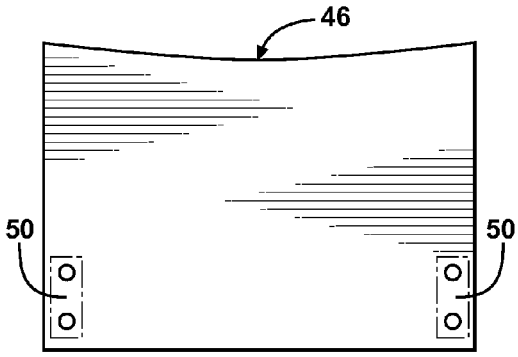
FIG - 10

METHOD FOR MANUFACTURING CUSTOM CHAIRS

CROSS REFERENCE TO RELATED APPLICATIONS

This application claims priority to U.S. Provisional Patent Application No. 60/933,809 filed Jun. 8, 2007.

BACKGROUND OF THE INVENTION

1. Field of the Invention

The present invention relates to the manufacturing of chairs, and more particularly to a method for efficiently manufacturing chairs having customizable backs.

2. Related Art

The introduction of chairs into Western Civilization is a relatively recent event as compared to the overall history of the Western world. Eastern cultures have only embraced chairs as a commonly used piece of furniture in recent decades by comparison. Indeed, there are still nomadic and rain forest cultures, among others, that do not employ chairs as we known them. In any event, the usefulness of the simple chair is often overlooked since it is so commonplace now and little thought is normally given to its origins or design.

Perhaps one reason why chairs arise later in the history of human culture may lie in the complexity involved in chair design. Again, this complexity is not often realized since chairs and chairs of many different design types are ubiquitous in modern societies. However, when one considers the loading and function of a chair, the design attributes are revealed. When a person sits in a chair, a load is distributed through the seat and back portions into the frame of the chair where it is eventually transmitted to the floor upon which the chair (and now the occupant) sits. This relationship between the components of a chair system is a dynamic environment that requires a solid understanding of the parametrics of chair design. Failure to observe these parameters is likely to result in wasted efforts and materials, as the chair manufacture will be producing furniture that will routinely fail when used.

As may be appreciated, early chair designs relied upon wood components and since these could be found in abundance, chair designs were generally robust and resulted from trial and error approaches. As modern construction materials became available, however, the use of steel, aluminum, stainless steel, and other alloys provided for greater strength in lighter frames of lesser overall substance. The upsurge in this type of chair design hit a stride in the 1950s with the increasing popularity of metal office and commercial furniture products. In these years, however, even the frames tended to be the result of overkill and were many times made so bulky or weighty that they were not well received by all potential users.

Modern chairs have the advantage of proven frame designs that utilize minimized and refined frames compared to the early types of metal based chairs. This has made the frame based chair design very popular for industrial, commercial and residential applications. Such frame chairs are usually found with complementary seat and back portions that may be made from wood, plastic or metal, and which may be finished or which may be upholstered with fabrics and the like. This frame chair is the predominant type of chair especially in industrial and commercial uses, and versions of the frame chair have merged well with residential uses as well. Since the frame for the chair can be reproduced using mass manufacturing techniques, large numbers of chairs can be produced at very reasonable cost. The downside, however, is that the variability in the final cosmetic appearance of the frame chair is limited as a result of this prior art manufacturing methodology leading to a product that is typically offered in one configuration with perhaps a number of different finishes and/or colors. This limitation will many times reduce the desirability of the frame chair where people are looking to purchase seating for their restaurants, offices, schools, or other applications and want to match an existing or proposed décor or where the desire is merely to have something distinguished from the catalog of mass manufactured options.

In U.S. Pat. No. 5,227,476 (Caldwell), a modular chair design is shown where the seat and back portions of the chair are independently associated with the "frame" of the chair and are easily assembled by the user. This modular chair design is predicated upon a substantial frame, preferably fabricated from wood components, and does not suggest a modular chair approach where customization of back and seat portions can be accomplished in the context of a mass production environment. Similarly, in U.S. Pat. No. 5,795,028 (Dussia, Jr. et al) an easy chair design is shown as being built up from a sub-frame, however this design is reliant on substantial componentry and does not teach a way to customize a frame chair in a mass manufacturing context.

U.S. Pat. No. 3,870,366 (Rogers) discloses a knock-down modular type of chair based on wood components. All of the components, including the frame, the seat and the back, are independent and are assembled as a kit. This reference does not teach a frame chair of a modular design type that can be fitted with an unlimited number of customized back and/or seat portions.

Furthermore, it is known in the chair making art to provide customers with a limited ability to customize certain aspects of a chair. For example, chair finish can be made to customer order, as well as various engraving or upholstering finishes. These prior art techniques are fairly limited, however, such that a designer has not the freedom to create interesting new shapes and chair profiles.

There exists therefore a longstanding need in the chair making industry, where a chair assembly can be more fully customized to a designer's intent without diminishing structural integrity or unduly affecting production speed.

SUMMARY OF THE INVENTION

A novel chair assembly is comprised of a frame for the retention of a backrest and a chair seat, where the backrest conforms to a select modular parameter and can be fitted onto the frame irrespective of the design treatment that is imparted to the backrest. The chair seat is similarly conformable to a select modular parameter and can be fitted onto the frame irrespective of the design treatment that is imparted to the chair seat.

Another version of the present invention comprises a method for manufacturing a frame chair with a customized backrest. The method includes the steps of standardizing a frame for a chair assembly, fabricating the frame for the chair, preparing a blank for the backrest within select parameters, selecting a customized design for the backrest, converting the design for the backrest into a readable format, loading the readable format for the chair design into a customized cutting apparatus, loading the blank into the cutting apparatus, cutting the blank in conformity with the selected and loaded backrest design, removing the completed blank from the cutting apparatus, mounting the backrest onto the frame, and lastly, mounting a seat onto the frame.

In a further version of the present embodiment includes the steps for customizing a chair seat.

BRIEF DESCRIPTION OF THE DRAWINGS

These and other features and advantages of the present invention will become more readily appreciated when considered in connection with the following detailed description and appended drawings, wherein:

FIG. 8 is a front view of a backrest blank having an initial profile and showing certain dimensional parameters and the mounting surfaces in shade;

FIG. 9 is one example of a completed backrest showing the backrest profile altered from the initial profile but yet the mounting surfaces in shade remaining unaltered.

FIG. 10 is an other example of a completed backrest showing the backrest profile altered from the initial profile but yet the mounting surfaces in shade remaining unaltered

DETAILED DESCRIPTION OF THE PREFERRED EMBODIMENT

Figure 2:
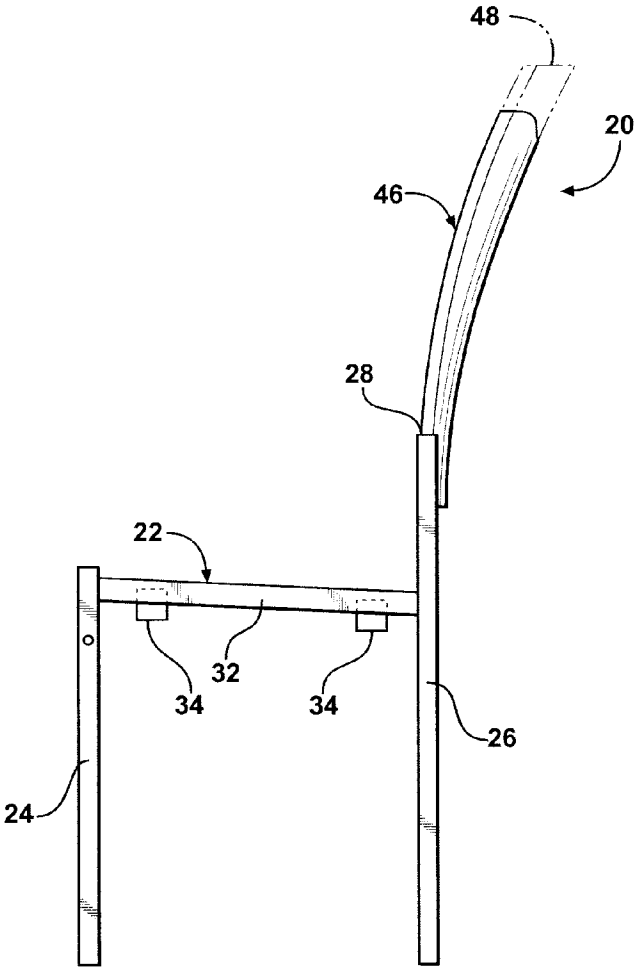
FIG. 2 is a right side view of the chair assembly shown in FIG. 1.

Referring to the Figures, wherein like numerals indicate like or corresponding parts throughout the several views, a chair assembly according to the subject invention is generally shown at 20. The chair assembly 20 has a rigid frame, generally indicated at 22, including at least two front legs 24 and two rear legs 26. Each rear leg 26 has an upper end 28. Preferably, the rear legs 26 are longer than the front legs 24, such that when set upright on a level surface, the upper ends 28 of the rear legs 26 are elevated above the front legs 24. The legs 24, 26 are made of tubular metal in the preferred embodiment of this invention. Although it will be appreciated that the legs 24, 26 can be made from other materials like wood or plastic, and do not need to maintain a round cross-section nor a consistent dimensional quality along their entire lengths.

Figure 1:
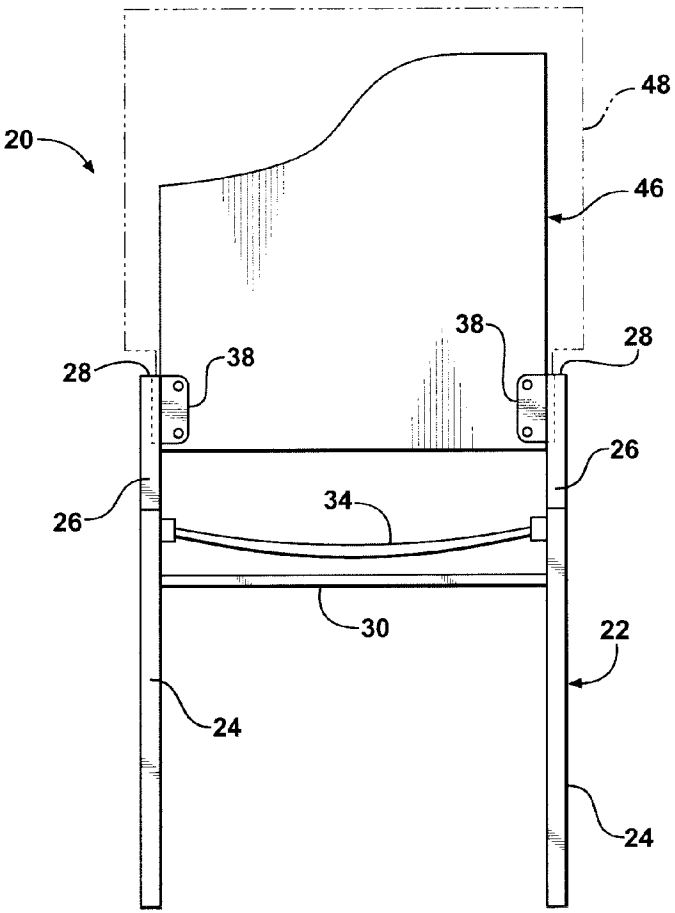
FIG. 1 is a front elevation view of a chair assembly according to the subject invention showing the backrest with an initial profile in phantom and a customized profile in solid.
Figure 3:
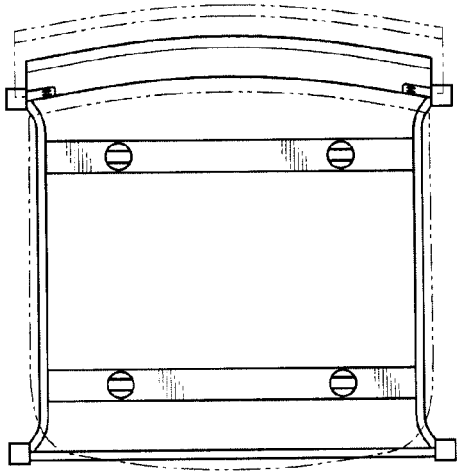
FIG. 3 is a top view of the chair assembly shown in FIG. 1.
Figure 12:
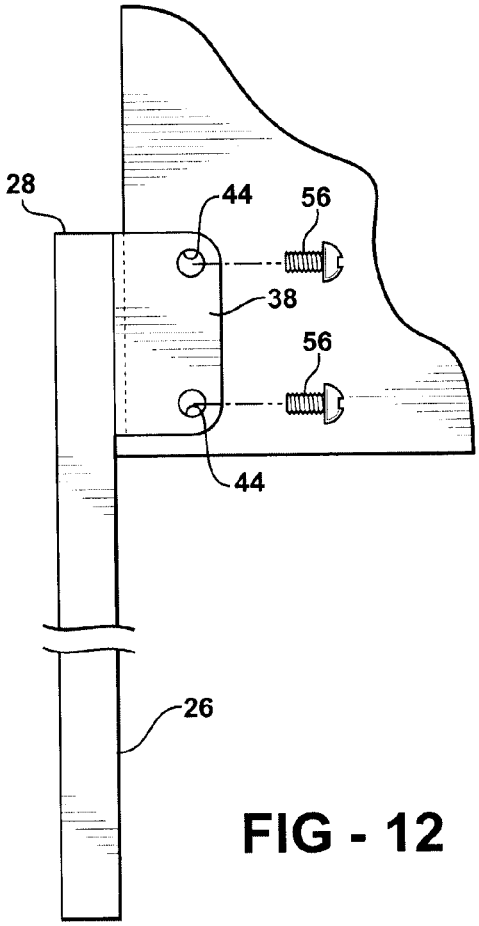
FIG. 12 is a fragmentary view of a rear leg of the chair frame showing the a portion of the backrest fastened to the mounting tab with exemplary mounting screws.

The front legs 24 are attached to one another with at least on front stretcher 30. The rear legs 26 can also be joined directly to one another with one or more rear stretchers, but in the preferred embodiment no rear stretcher is used for reasons to be described subsequently. Each rear leg 26 is directly connected to one respective front leg 24 with at least one chair rail 32. Thus, two or more chair rails 32 extend between the front 24 and rear 26 legs to hold the leg 24, 26 in a generally vertical orientation and arranged in a generally square or trapezoidal configuration. A pair of transverse seat supports 34 extends between the chair rails 32, and may be slightly curved as shown in FIG. 12 to accommodate a complimentary contoured seat 36. A seat 36 is shown in the fully assembled chair examples of FIG. 14. In FIGS. 1-3, the seat 36 is omitted from the chair assembly 20 for clarity.

Figure 11:
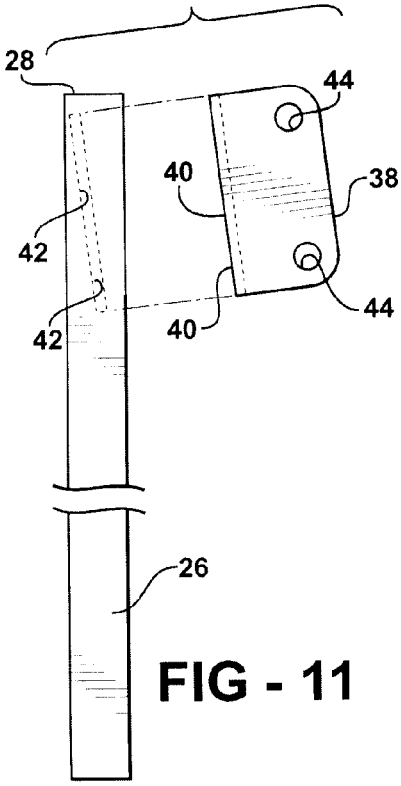
FIG. 11 is a fragmentary view of a rear leg of the chair frame showing the mounting tab exploded away.

A mounting tab 38 is affixed to each rear leg 26 adjacent the upper end 28 thereof. The mounting tabs 38 are laterally spaced apart from one another a fixed distance. In the preferred embodiment, the mounting tabs 38 are plate-like members that are slightly skewed relative to the longitudinal extent of the respective rear legs 26, such that the uppermost edges of the mounting tabs 38 are tilted toward the back. As perhaps best shown in FIG. 11, each mounting tab 38 has at least one, and preferably two, tennons 40 adapted to mate with complimentary mortises 42 in the respective rear leg 26. The mounting tabs 38 can be secured in their respective mortises 42 on the rear legs 26 with a carefully applied weld (in the case of metal legs 24, 26), or glue or other bonding agent (in the case of wooden or plastic legs 24, 26). Each mounting tab 38 is machined to include two (or more) fastener holes 44.

Figure 6:
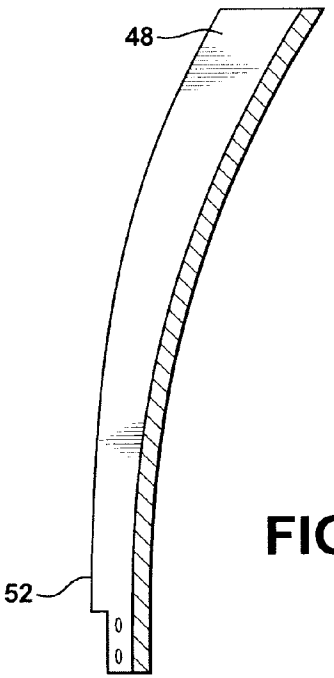
FIG. 6 is a cross-sectional view taken generally along lines 6-6 in FIG. 4.
Figure 5:
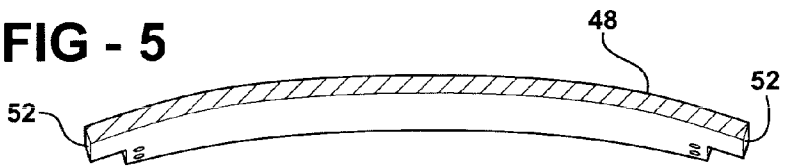
FIG. 5 is a cross-sectional view taken generally along lines 5-5 in FIG. 4.
Figure 4:
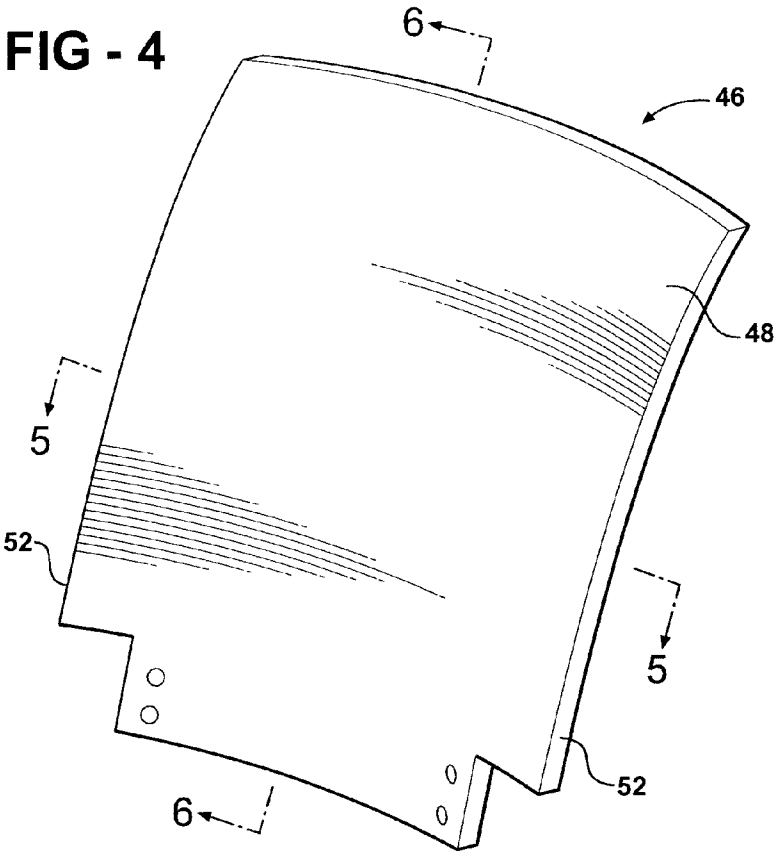
FIG. 4 is a perspective view of a backrest blank showing an initial profile.
Figure 7A:
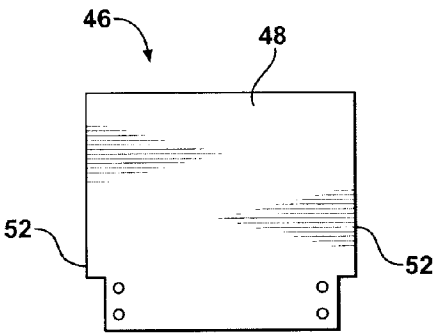
FIGS. 7A-F depict a sequence of manufacturing steps, wherein a backrest blank is transformed into a finished backrest according to the subject invention.
Figure 7B:
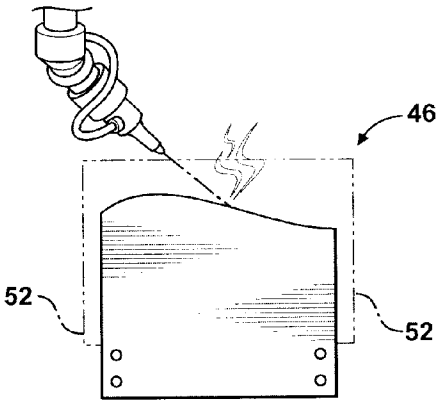

The subject invention is directed particularly toward a method for manufacturing chair assemblies 20 having a backrest, generally indicated at 46, with a profile that is easily configurable at the design inspiration of a customer. To accomplish this objective, the backrest 46 is formed from a chair back blank 48 having an initial profile, as illustrated in broken lines in FIGS. 1-3 and in solid lines in FIGS. 4-6. The blank 48 has a generally uniform thickness and is generally rigid so as to maintain compound curved contours adapted to conform to the backside of a human torso. The compound curving design of the blank 48 is perhaps best shown in FIGS. 4-6. Preferably, the blank 48 is formed by laminating several thinly sliced wood sheets back-to-back while compressing them between opposing mold surfaces. Of course, non-plywood materials can be used with effectiveness, such as metal, masonite, high pressure laminates, and machinable acrylics, to name a few. The blank 48 has a dimensional height A and a dimensional width B as described in FIG. 8. The blank 48 has an initial profile, defined as the shape as viewed from the front like that in FIGS. 1, 7A and 8.

Two mounting surfaces 50 are established on the blank 48, along its lowermost edge at the extreme outward sides. In FIG. 8, the mounting surfaces 50 are shown as shaded areas of generally rectangular shape corresponding in size to the mounting tabs 38. Accordingly, the mounting surfaces 50 are laterally spaced apart from one another a distance X corresponding to the mounting tabs 38 on the rear legs 26. In FIG. 8, the mounting surfaces 50 are depicted having a height Y. Two fastener holes 51 are milled in each mounting surface 50. These holes 51 can be drilled, laser cut, punched or in some other manner created in the blank 48 to correspond with the fastener holes 44 in the mounting tabs 38. Preferably, side extensions 52 are created above the mounting surfaces 50, enabling the dimensional width B to be greater than the outside distance X between the mounting surfaces 50. The outside distance X corresponds to the lateral spacing between the rear legs 26, whereas the dimensional width B establishes a maximum width for the finished backrest 46.

FIGS. 9 and 10 represent two sample backrest 46 profiles altered from the initial profile of FIG. 8. These illustrations depict how the spacing between the mounting surfaces 50 remains unaltered during the profile reconfiguration process.

Figure 7C:
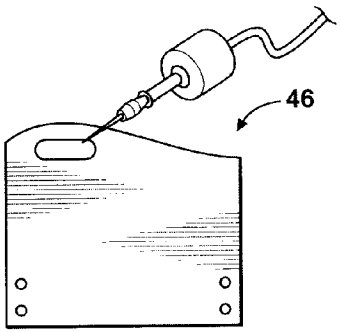

Referring now to FIGS. 7A-F, an exemplary manufacturing sequence for configuring a backrest 46 to customer order is shown. The sequence begins by providing the backrest blank 48 as described above. A customer request is received to manufacture a chair assembly 20 having a backrest 46 profile that is different than the initial profile. Based on the desired new profile requested by the customer, the backrest 48 profile is cut, such as by a computer controlled laser cutting device shown in FIG. 7B, without altering its compound curved contours and without altering the lateral spacing between the mounting surfaces 50. As an alternative to laser cutting, any known technique can be used to reconfigure the backrest 46 profile, including CNC routing, or water jet cutting to name a few. Fully inset, or included, holes and other shapes can also be imparted to the backrest 46 to achieve desired design or functional elements as illustrated in FIG. 7C. As one example, an ergonomically shaped cutout can be milled near the top edge of the backrest 46 to serve as a handle. Other included shapes can likewise be cut into the backrest 46.

Figure 7D:
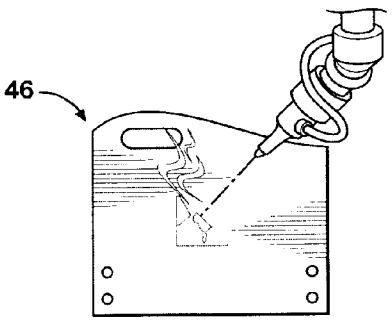
Figure 7E:
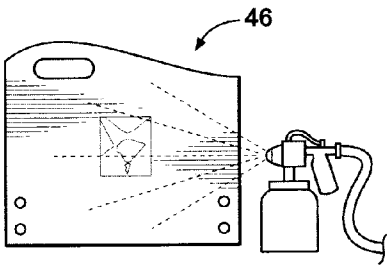
Figure 7F:
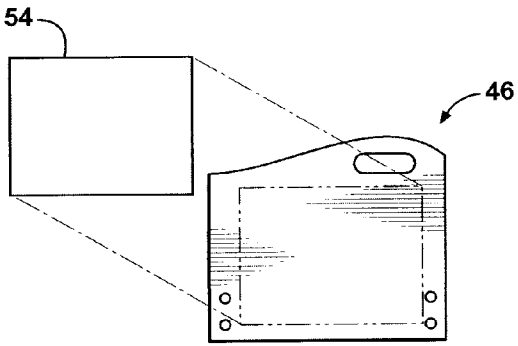

FIGS. 7D-7F illustrate various optional and/or alternative steps of applying a surface treatment to the reshaped backrest 46. FIG. 7D, more specifically, shows a laser etching process, wherein a decorate picture, logo, word or other feature is burned into the surface of the backrest 46. Although not shown, surface treatments can also include various forms of grooving and embossing, which can be accomplished using CNC routing or other suitable technique. A spraying process is depicted in FIG. 7E, which can represent a painting or staining operation, clear coating operation, or other application of atomized coating material as a surface treatment to the reshaped backrest 46. In FIG. 7F, an upholstered pad 54 is shown as another form of surface treatment. The shape as well as the color of the resilient pad 54 can be designed by the customer to accomplish their particular design intention.

Once the backrest 46 has been fully fabricated and configured to the customer's specification, it is fastened to the chair frame 22 by mechanically connecting the mounting surfaces 50 directly to respective mounting tabs 38 as shown in FIG. 12. While screws 56 are used as exemplary illustrations in FIG. 12, it will be appreciated that other fastening techniques know to those of skill in the art can be substituted for the screws 56. The rigid nature of the backrest 46 provides structural support to the chair frame 22, thus enabling the need for a rear leg stretcher in some applications.

Figure 13:
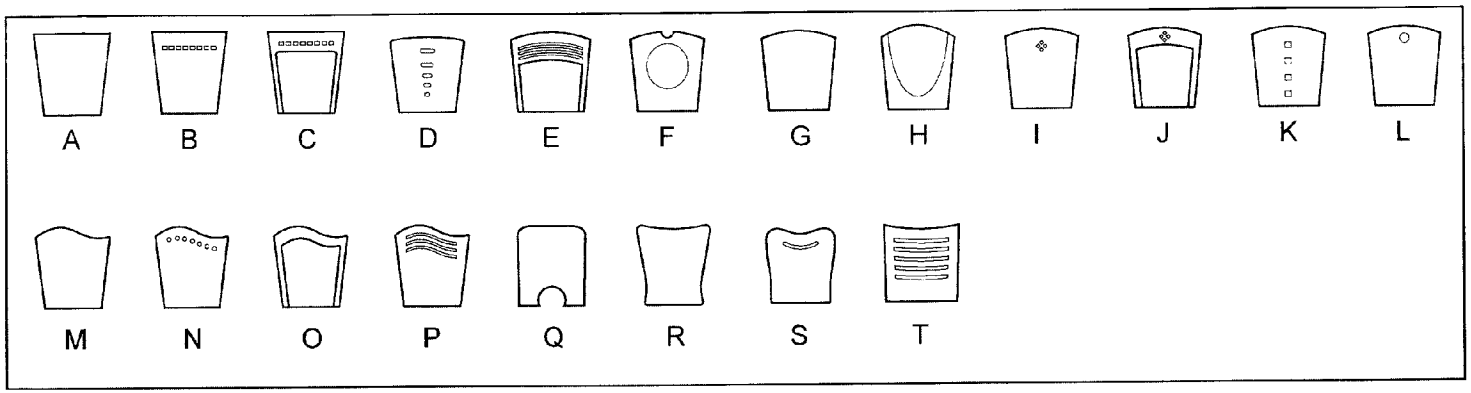
FIG. 13 is an exemplary collection of backrest designs that can be fabricated for a chair assembly according to this invention, wherein the backrest contour is unaltered from that of the blank and the mounting surfaces likewise remaining unaltered.

A novel method for manufacturing a frame chair 22, and the resulting chair assembly 20, are the subjects of the present invention. Chair frame designs of the prior art inherently limit the ability of chair manufacturers to easily fulfill custom requirements of the purchaser. With the present invention, however, it is possible for the purchaser to specify the type of backrest 46 design treatment he/she may desire, including cuts, embosses, and outer shapes. Virtually any design intent of the customer may be readily implemented. Examples of customized backrests 46 of the present invention are shown in FIG. 13, wherein discrete designs are identified with reference letters A-T. In each example, the backrest 46 profile is a reconfigured form of the initial profile, and the mounting surfaces 50 remain unaltered in terms of their relative spacing one from another so that they can be attached to the mounting tabs 38 in the manner described above.

Figure 14:
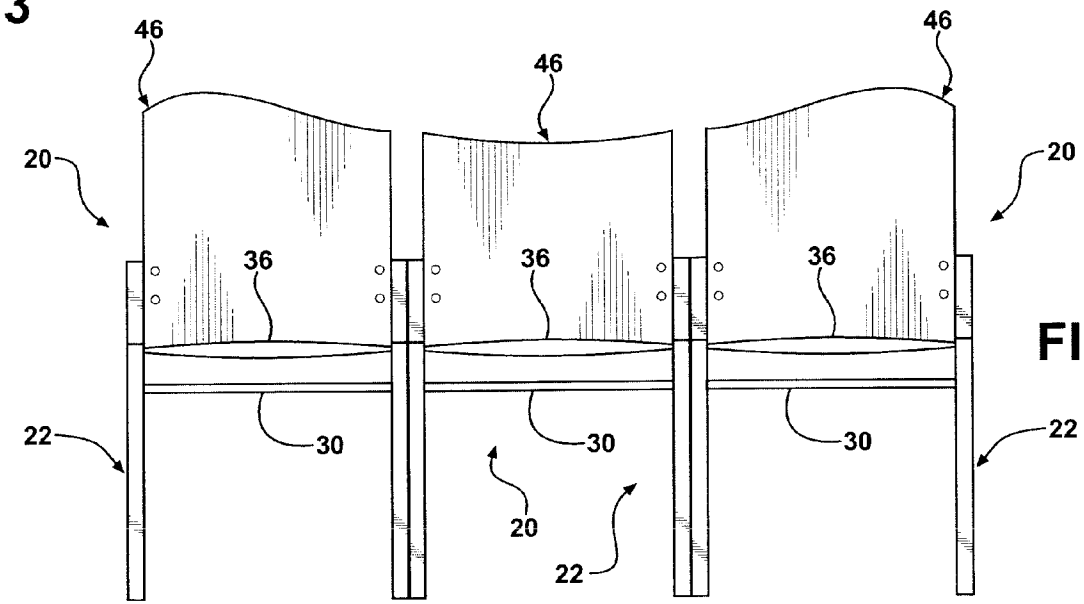
FIG. 14 is another exemplary view showing three side-by-side chair assemblies according to the subject invention, each chair assembly having a unique backrest profile that comprises a partial design theme, and wherein the design theme is completed when the chairs are arranged in a group of three.

FIG. 14 shows the effect of combining related design treatments among juxtaposed chair assemblies 20. In this example, each backrest 46 carries a related partial design theme which can be expressed as a whole only when the chairs 20 are arranged in a group of three (or two or more).

Although not shown in any of the figures, those of skill in the art will recognize that a chair 20 of the present invention may be fitted with arm rests and possibly other features without detracting from the novel aspects described above.

In use, the modular chair system of the present invention is reliant upon the dimensional envelope in which the backrest 46, and to a lesser degree the chair seat 36, may be allowed to exist. This envelope is comprised of the outer parameters A and B which define the maximal area which the backrest 46 can occupy. The dimensional envelope is also comprised of the mounting parameters, X and Y which define the area for a select configuration for the backrest, typically a lowermost portion of the blank 48, with height Y which roughly corresponds to the height of each mounting tab 38 and with width X which roughly corresponds to the distance between the rear legs 26. This dimensional envelope for the backrest 46 is the basis that allows for the liberality in selecting different design treatments.

For the first time a customer will have the unfettered capability to design their own furniture (within the boundaries explained above) which encompasses an endless array of possibilities. For example, embossing can be accomplished using CNC routing on a selected wood substrate and can range from intricate carvings, logos and names, geometric patterns, and so on.

As may be inferred for the foregoing discussion, the manufacturer of a chair 20 product of the present invention can utilize mass manufacturing techniques for the production of the frame 22. The frames 22 can be easily standardized from which fixturing, jigs, tooling, and other manufacturing tools can be configured with the end result that the frame 22 can be made for nearly the same costs as frames for non-customized chair products. This renders a great advantage to the present invention which allows the chair products to be sold to a much larger market.

The customization of the chair seat 36 can occur in the same manner as set forth above, although there are practical and cosmetic reason why this approach will likely be less utilized than the customization of the backrest 46. Even if a standard chair seat 36 is settled upon for use in conjunction with the present invention, the standard chair seat 36 can be matched to meet the cosmetic selections, base material selections and the like, that are made by the customer.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A method for manufacturing chairs having reconfigurable backrest profiles, said method comprising the steps of:

providing a chair frame having at least two rear legs, each rear leg having an upper end;

affixing a mounting tab to each rear leg adjacent the upper end thereof, such that the mounting tabs are laterally spaced apart from one another a fixed distance;

forming chair back blanks having a generally uniform thickness and being generally rigid so as to maintain compound curved contours adapted to conform to the backside of a human torso, the blank having a dimensional width and a dimensional height and an initial profile;

establishing a pair of mounting surfaces on the blank, the mounting surfaces being laterally spaced apart from another a distance corresponding to the mounting tabs on the rear legs;

receiving a customer request to manufacture a chair having a backrest profile that is different than the initial profile;

reshaping the backrest profile without altering the compound curved contours and without altering the lateral spacing between the mounting surfaces;

applying at least one surface treatment to the reshaped backrest; and fastening the reshaped backrest to the chair frame by mechanically connecting the mounting surfaces directly to respective mounting tabs.

2. The method of claim 1 wherein said step of reshaping the backrest profile includes laser cutting the blank.

3. The method of claim 2 wherein said step of reshaping the backrest profile includes forming at least one fully included hole in the blank.

4. The method of claim 1 wherein said step of establishing a pair of mounting surfaces includes forming fastener holes in the blank.

5. The method of claim 1 wherein said step of applying at least one surface treatment includes laser etching.

6. The method of claim 1 wherein said step of applying at least one surface treatment includes coating the backrest with a coating material.

7. The method of claim 1 wherein said step of applying at least one surface treatment includes attaching a resilient pad element.

8. The method of claim 1 wherein said step of forming chair back blanks includes creating side extensions above the mounting surfaces.

9. The method of claim 1 wherein said step of affixing a mounting tab includes skewing the mounting tab relative to the longitudinal extent of the respective rear leg.

10. The method of claim 9 wherein said step of affixing a mounting tab includes receiving a tennon on the tab into a complimentary mortise in the respective rear leg.

11. The method of claim 1 wherein said step of establishing a pair of mounting surfaces includes locating the mounting surfaces adjacent the extreme lower edge of the blank.

12. The method of claim 1 wherein said step of providing a chair frame includes attaching each rear leg to a front leg with at least one chair rail, and attaching the two front legs to one another with at least on front stretcher.

13. A method for manufacturing chairs having reconfigurable backrest profiles, said method comprising the steps of:

providing a chair frame having at least two rear legs, each rear leg having an upper end, attaching each rear leg to a front leg with at least one chair rail, and attaching the two front legs to one another with at least on front stretcher;

affixing a mounting tab to each rear leg adjacent the upper end thereof, such that the mounting tabs are laterally spaced apart from one another a fixed distance, skewing the mounting tab relative to the longitudinal extent of the respective rear leg, and receiving a tennon on the tab into a complimentary mortise in the respective rear leg;

forming chair back blanks having a generally uniform thickness and being generally rigid so as to maintain compound curved contours adapted to conform to the backside of a human torso, the blank having a dimensional width and a dimensional height and an initial profile;

establishing a pair of mounting surfaces on the blank, the mounting surfaces being laterally spaced apart from another a distance corresponding to the mounting tabs on the rear legs, forming fastener holes in the blank through each of the mounting holes, locating the mounting surfaces adjacent the extreme lower edge of the blank;

receiving a customer request to manufacture a chair having a backrest profile that is different than the initial profile;

reshaping the backrest profile by laser cutting without altering the compound curved contours and without altering the lateral spacing between the mounting surfaces;

applying at least one surface treatment to the reshaped backrest, the surface treatment selected from the group of: laser etching, coating with a coating material, and attaching a resilient pad element; and fastening the reshaped backrest to the chair frame by mechanically connecting the mounting surfaces directly to respective mounting tabs.

14. A method for manufacturing a chair assembly with a customized backrest, said method including the steps of: standardizing a frame for a chair assembly; fabricating the frame for the chair assembly; preparing a blank for the backrest within select dimensional parameters, the blank having a generally uniform thickness and being generally rigid so as to maintain compound curved contours adapted to conform to the backside of a human torso; selecting a customized design for the backrest, the customized design having a reshaped backrest profile which maintains the compound curved contours of the blank; converting the design for the backrest into a machine-readable format; loading the machine-readable format for the backrest design into a computer-controlled cutting apparatus; loading the blank into the cutting apparatus; cutting the blank in conformity with the selected backrest design; removing the completed backrest from the cutting apparatus; fastening the backrest onto the frame; and mounting a seat onto the frame.

15. The method of claim 14 further including the step of applying at least one surface treatment to the backrest prior to said fastening step, the surface treatment selected from the group of: laser etching, coating with a coating material, and attaching a resilient pad element.

16. The method of claim 14 wherein said step of fabricating the frame includes providing at least two rear legs, each rear leg having an upper end, attaching each rear leg to a front leg with at least one chair rail, and attaching the two front legs to one another with at least on front stretcher.

17. The method of claim 16, further including the steps of affixing a mounting tab to each rear leg adjacent the upper end thereof, such that the mounting tabs are laterally spaced apart from one another a fixed distance, skewing the mounting tab relative to the longitudinal extent of the respective rear leg, and receiving a tennon on the tab into a complimentary mortise in the respective rear leg.

18. The method of claim 17 wherein said step of preparing a blank includes establishing a pair of mounting surfaces on the blank, the mounting surfaces being laterally spaced apart from another a distance corresponding to the mounting tabs on the rear legs, forming fastener holes in the blank through each of the mounting holes, locating the mounting surfaces adjacent the extreme lower edge of the blank.

* * * * *